United States Patent [19]

Gerstung

[11] Patent Number: 4,856,684

[45] Date of Patent: Aug. 15, 1989

[54] VALVE FOR A PRESSURIZED DISPENSING CAN CONTAINING FLOWABLE MATERIALS

[76] Inventor: William Gerstung, 27705 Hyssop La., Santa Clarita, Calif. 91350-1645

[21] Appl. No.: 171,070

[22] Filed: Mar. 21, 1988

Related U.S. Application Data

[63] Continuation-in-part of Ser. No. 34,679, Apr. 6, 1987, abandoned, and a continuation of Ser. No. 113,995, Oct. 29, 1987, abandoned.

[51] Int. Cl.[4] ..... B65D 83/00

[52] U.S. Cl. ..... 222/402.23; 222/394

[58] Field of Search ..... 222/402.21–402.25, 222/394; 251/354

[56] References Cited

U.S. PATENT DOCUMENTS

| | | | |
|---|---|---|---|
| 2,869,764 | 1/1959 | Collins | 222/402.23 |
| 2,889,086 | 6/1959 | Collins | 222/402.22 |
| 2,994,461 | 8/1961 | Michel | 222/402.22 X |
| 3,079,048 | 2/1963 | Wolfson et al. | 222/402.23 X |
| 3,447,779 | 6/1969 | Huling | 222/402.23 X |
| 3,758,007 | 9/1973 | Rosen | 222/402.23 X |
| 4,171,757 | 10/1979 | Diamond | 222/402.22 |

*Primary Examiner*—Michael S. Huppert

[57] ABSTRACT

The valve is for use on a gas pressurized liquid food dispensing container or can, such as a whipped cream dispensing can. The valve includes a dish-shaped, preferably metal can top connector having a vertical opening up through which extends the vertical rod portion of a valve stem disposed within a passageway in a vertical tubular portion of a rubber grommet. The upper end of the grommet engages the lower end of an expanded head on the stem rod to hold the stem yieldingly in place in assembly. The horizontal lower end of the grommet abuts the lower end of the connector and the upper end of the horizontal base of the valve stem so as to releasably seal the connector opening therewith. An open-topped vertical cover is releasably secured by the grommet upper tubular portion, as by ribs or detents or threading and can be tilted sideways with the grommet upper tubular portion to tilt the stem base from its sealing position to release liquid from the can. The lower portion of the stem rod is generally conical and the grommet has an annular ring with pointed inner rim bearing thereagainst for improved sealing engagement, inadvertent "blow-by" of liquid and solids and build-up of solids from the can. An annular ridge may be provided on the grommet inner passageway wall directly in the tilt path of the stem base to act as a fulcrum for earlier and easier dispensing from the can.

6 Claims, 3 Drawing Sheets

PRIOR ART

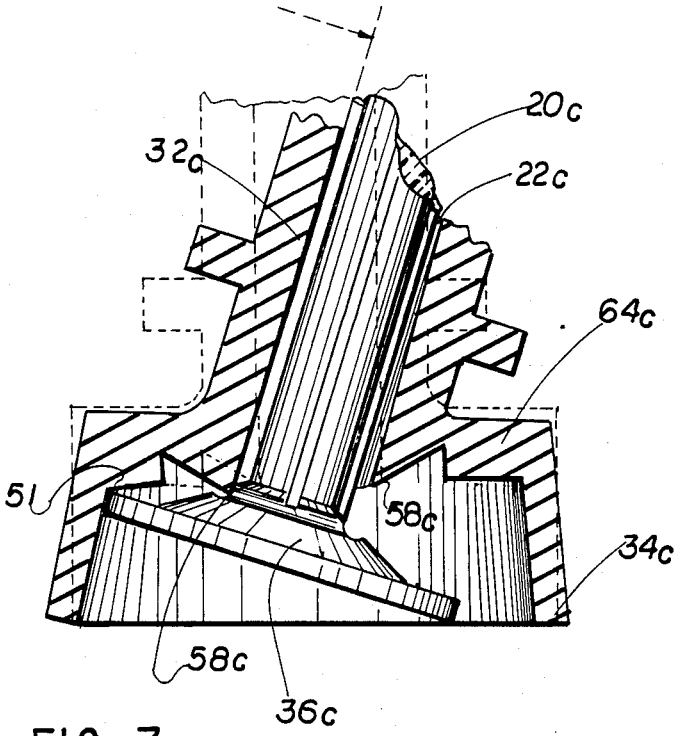
FIG. 7
FIG. 9
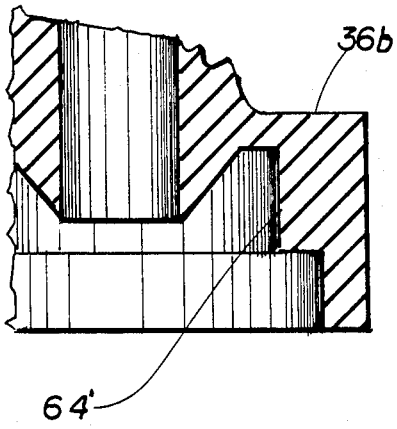
FIG. 8
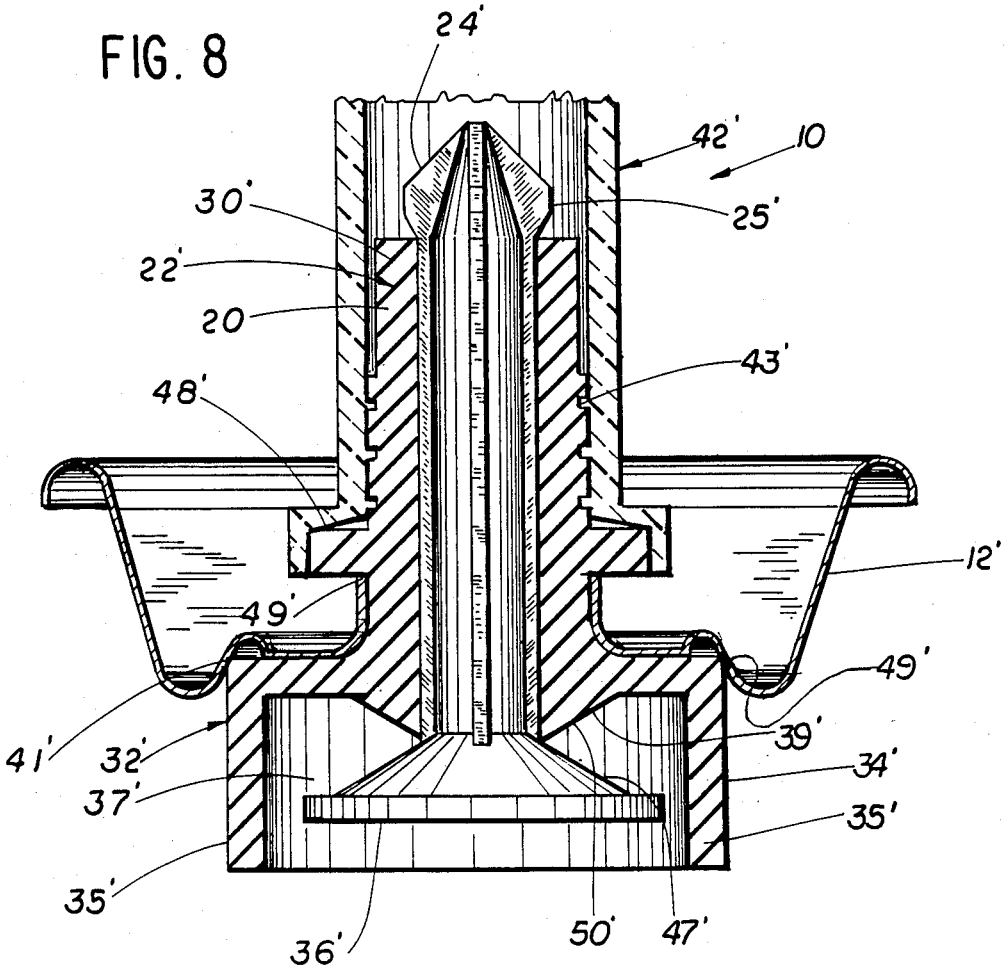

VALVE FOR A PRESSURIZED DISPENSING CAN CONTAINING FLOWABLE MATERIALS

This application is a continuation-in-part application of my earlier filed patent application Ser. No. 034,679 filed Apr. 6, 1987 and now abandoned and a continuation of my earlier application Ser. No. 113,995 filed Oct. 29, 1987, now abandoned.

BACKGROUND OF THE INVENTION

1. Field of the Invention

The present invention generally relates to valves and, more particularly, to valves of the type used with pressurized dispensing cans to control removal of contents from such cans.

2. Prior Art Statement

The prior art known to the applicant is the conventional pressurized liquid food dispensing can valve such as is illustrated in FIG. 1 of the accompanying drawings, and such is generally employed to dispense whipped cream and whipped cream-like substances from small containers sold in grocery stores and the like. The valves of such cans generally employ an outer plastic cover having an internal ring detent with upwardly converging walls which are adapted to about the lower surfaces of an arrow-shaped head of the valve stem employed in the valve, making it impossible to retract the valve stem once the head is shoved up past the detent.

Unfortunately, with this arrangement, the outer cover is also locked in place and cannot be removed to expose the valve stem for cleaning. Some of the whipped cream and the like dispensed from the can normally becomes trapped between the cover and valve stem head and is subject to hardening, decomposition, development of bad smells and rancidity, etc., making it a health hazard and an unsightly mess. Over a period of time, sufficient build-up of whipped cream or the like can occur to even impair the proper operation of the valve.

There generally is also a build-up of such material in the area of contact between the moveable valve stem and its seal, causing gradual oozing out of the dispensing material. There is generally a further problem in the slowness and difficulty encountered in causing the valve to tilt to the dispensing position.

Accordingly, there is a need for an improved valve for pressurized liquid food dispensing cans which will permit easy disassembly and clean-up of the valve without loss of can pressure and which will assure proper operation over a long period of time without becoming a health hazard. Such valve should be simple, durable, inexpensive and efficient. Importantly, such a valve should also include a sealing means effective through a range of pressure, i.e. (a) from a relatively high initial pressure to avoid "blow-by" to (b) a relatively low pressure when the container contents are substantially discharged to avoid oozing, and prevent "low pressure leak" allowing propellent to escape. Also, the valve should dispense rapidly and without difficulty.

Representative prior art includes U.S. Pat. No. 3,447,779 which shows a valve for the purpose described herein generally, namely, dispensing flowable material from a pressurized container. That patent, however, does not include the sealing structure as is described more fully herein. The prior art also includes U.S. Pat. No. 2,869,764 which also does not disclose the sealing structure of this invention. U.S. Pat. No. 3,954,208 provides a dispensing valve structure with a different type of sealing means than is disclosed herein. Similarly, U.S. Pat. Nos. 2,487,434, 3,450,316 and 3,079,048 disclose structures of valves for pressurized containers without the improved sealing means of this invention.

SUMMARY OF THE INVENTION

The valve of the present invention is substantially as set forth in the initial Abstract. Thus, it includes a dish-shaped connector ring bearing a vertical central opening up through which the vertical rod of a valve stem is disposed. The rod has an upper arrow-shaped head with peripheral flanges and at its lower end is provided with a horizontal hole-sealing base. A tubular grommet is provided about the valve stem. The grommet is of a rubbery material and is disposed around the rod with the rod in the central passageway of the grommet. The hollow tubular portion restingly support the underside of the rod head when the valve is not installed on a pressurized container. The grommet is also connected below the connector opening to a horizontal lower portion which cooperates with and is disposed above the stem base so as to releasably seal the connector opening.

An improved annular ring seal on the grommet is provided to bear against a cone-shaped lower portion of the stem rod when the valve is under pressure to provide an effective labyrinth-type seal and prevent entrapment of dispensing material. The ring seal has a radially inwardly and axially downwardly pointed inner rim or lip. Also, in one embodiment, see FIG. 7, faster and easier dispensing from the can is effected by providing an annular ridge on the inside of the grommet in the tilt path of the stem base. This ridge acts as a fulcrum to cause earlier displacement of the base and thus earlier dispensing from the can on tilting movement of the valve stem.

A relatively rigid open-topped cover is releasably secured to the outer surface of the grommet upper tubular portion, as by threading or by functionally engageable ribs, detents, etc. The cover does not engage the rod head and thus is easily removable from around the grommet so that the cover, grommet and rod can be readily cleaned and then the cover can be reinstalled. Thus, the valve can be kept sanitary and in good working order, after each use.

The value of the present invention is simple, inexpensive, durable and efficient, as well as being easily cleanable and faster operating. The specifically configured grommet adjacent the lower end of the stem rod and stem base prevents inadvertent "blow-by" of liquid from the can and entrapment of liquid therebetween when under the influence of initial pressure after installation on a can, and also, oozing, when the can is almost empty of its contents. Various other features of the invention are set forth in the following detailed description and are accompanying drawings.

BRIEF DESCRIPTION OF THE DRAWINGS

FIG. 7 is an enlarged, fragmentary schematic side elevation, partly broken away and partly in section, of a third preferred embodiment of an improved grommet utilizable in the valve of FIG. 2 showing a different tilt ridge; and FIG. 8 is a partial side elevation, partly broken away, and illustrating the first preferred embodiment.

FIG. 9 is a partial side elevation, broken away and in section of a fourth preferred embodiment of the grommet.

DETAILED DESCRIPTION

Figure 1:
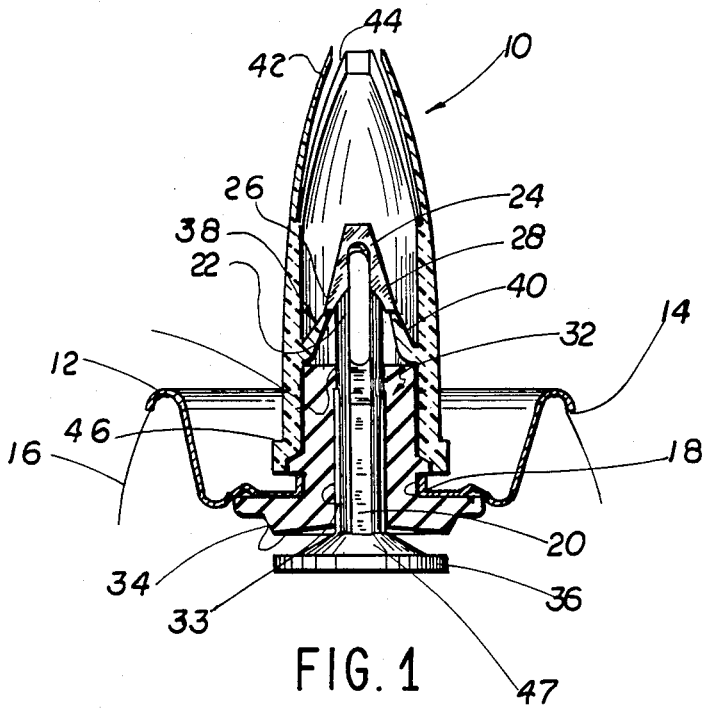
FIG. 1 is a schematic side elevation, partly broken away, of a conventional prior art valve for a liquid dispensing can.

The known prior art is schematically illustrated in FIG. 1. Thus, valve 10 is shown which comprises a dish-shaped metal connector 12 sealingly engageable with the top 14 of a pressurized liquid food dispensing can 16 or the like. Connector 12 has a central vertical opening 18 extending up therethrough, up through which passes the vertical rod 20 of a valve stem 22. The upper end of rod 20 bears an expanded arrow-shaped head 24 having a pair of downwardly and outwardly depending flanges 26 and 28.

The upper hollow tubular portion 30 of a rubber grommet 32 is disposed around the lower portion of rod 20, with rod 20 vertical in passageway defined by the wall 33 of grommet 32. Grommet 32 passes down through opening 18 to connect with an expanded horizontal disc-shaped base 34 of grommet 32. Base 34 abuts the underside of connector 12 and serves as a seal for the expanded horizontal base 36 of valve stem 22. Base 36 is connected to the lower end of rod 20 and serves to releasably close opening 18.

Valve stem 22 is held in the closed position shown in FIG. 1 by a circular ring detent 38 having upwardly converging walls 40 which engage the underside of overlying flanges 26 and 28. Walls 40 are integrally connected to the inner surface of hollow tubular cover 42, the upper end 44 of which is open and tulip shaped and the lower end 46 of which is open and expanded to seat on the upper surface of connector 12 over portion 30 of grommet 32. Preferably, cover 42 is plastic with slight flexibility and walls 40 may be split to facilitate their spreading.

Grommet 32 contacts the conical-shaped lower portion 44 of rod 20 as at the zone indicated by the numeral 47 at the lower end of grommet wall 33. Such seal characteristically tends to trap entrained solids from the material disposed from can 16 and to cause an undesirable slow leaking of material from can 16 as the seal becomes more and more ineffective.

When valve 10 is assembled, cover 42 is the last component to be put in place. As it is pushed down over rod 20 and head 24, head 24 is forced up through ring detent 38, expanding detent 38 slightly until head 24 reaches the position shown in FIG. 1. In this position, cover 42 is locked on valve 10 and cannot be removed. Walls 40 are trapped below flanges 38 and 40 and hold stem 22. Valve 10 is operated by pivoting or tilting cover 40 and grommet portion 30 sideways under finger pressure to cause stem base 36 to tilt away from grommet base 34 and thus expose a pathway past 47 for passage of pressurized liquid from can 16. Release of such side pressure effects automatic closing of opening 18. Since in this type structure, cover 42 cannot be removed from stem 22, a part of the dispensed liquid food characteristically becomes trapped between cover 42, grommet 32, rod 20 and head 24, as well as between grommet rim 47 and conical portion 44 of rod 20, causing the aforementioned health hazards.

The first preferred embodiment may be best understood on initial reference to FIG. 8. In FIG. 8, the components which are generally similar to those of FIG. 1 bear the same numerals but are designated with a prime designation, "′". In FIG. 8, the improved valve 10′ is for attachment to the open upper end 14′ of a container 16′ for controlling the discharge of pressurized, flowable material from the container. The valve includes sealing means which are effective for preventing "blow-by" and oozing through a range of pressures from an initial elevated pressure to a lower pressure when the flowable material is substantially discharged from the container. More in detail, the valve 10′ is seen to include a can connector 12′, a valve stem 22′, a grommet 32′ and an open-topped vertical cover 42′. The can connector 12′ is of rigid material and, as is conventional, is adapted to sealingly close a container about its open upper end. The connector has a vertical opening extending through it 18′ which is bounded by an edge 19′. Ordinarily, such connectors are attached to a pressurized can by crimping.

The valve stem 22′ is of rigid material. It is composed of a horizontal base 36′ positioned below the connector 12′ when in assembly in the opening 18′ of the connector 12′. The valve stem includes a generally vertical rod 20′ extending upwardly from the base 36′ and through the opening 18′. The rod includes an upper distal end comprising a peripherally extending, expanded, open work or grid type head 24′. This defines a shoulder surface 25′ which faces the valve stem base 36′. Also, the base has a generally conical portion defining a surface 47′ extending upwardly and converging from the base 36′ to the rod 22′. Thus, the upper axially facing surface of the base includes the conical portion surface 47′.

The grommet 32′ is tubular having an axial passageway 41′; and it is of flexible, resilient material. It includes a lower portion 34′ which preferably defines a cylindrical skirt 35′ about a downwardly opening recess 37′. Within the recess, an inverted dome-shaped axially downwardly facing surface 39′ is located. This surface has a lip 50′ about the passageway 41′. The grommet also includes an upper vertically extending portion 30′ which is disposed about the valve stem rod with the rod in the passageway, and with the valve stem base 36′ closely adjacent the inverted dome-shaped surface in the skirt. The grommet also has an upper surface 43' at the upper end of the vertically extending portion which face has been designated by the numeral 43'. In assembly, the surface 25' of the valve stem head which faces the valve stem base dwells on the upper grommet face 43' to hold the valve stem in assembly. The lower portion 34' of the grommet, in assembly, is below the connector opening 18' with the upper surface 39' in the recess within the skirt confronting the upper surface of the valve stem base 36'. The grommet, valve and valve stem are sized and configured with the lip 50' in a normal position closely adjacent to the conical surface 47'. Finally, on the exterior surface of the grommet, there are mutually interengaging means 48' and 49' which captivate the edge of the opening of the connector 12' to sealingly close about the edge of that opening 18'.

It is thus seen that the grommet lip 50' comprises a sealing ring in the passageway 41' which is in sealing engagement with the generally conical surface 47' of the rod 22' when the valve is installed in closing relation on the open upper end of a pressurized container and axially upwardly directed forces are exerted on the valve stem base 36' which deforms the inverted dome-shaped surface upwardly as well as the lip 50'. It is seen that the grommet lip 50' is an annular, deformable, pointed grommet portion which is of generally transverse cross-section, as seen in elevation, with the apex 51' of the grommet portion defining a generally radially inwardly and downwardly pointed, distally weakened lip portion for sealing engagement with the conical portion of the rod. Preferably, the bisectrix of the apex is perpendicular to the conical surface 47'. When under pressure, it is seen that the grommet generally dome-shaped surface and the apex 51' are effective to deformingly and sealingly contact the upper axially facing surface of the valve stem base, including the conical portion surface 47' when the container is under elevated, initial pressure to guard against "blow-by" of pressurized liquid and to eliminate entrapment of entrained solids between the grommet and the valve stem, and that as the pressure is reduced, on removal of a portion of the flowable material from the container, the roof and pointed, distally weakened lip portion is adapted to gradually relax returning toward its normal position with the apex 51' of the lip portion maintaining sealing contact with the conical portion 47', which prevents "low pressure" leaking. This forms what may be considered to be a pressure self-adjusting seal.

The open tubular vertically extending cover 42' is releasably secured to the tubular portion 30' of the grommet 32' above the connector opening 18'. This facilitates removal of the cover and cleaning of the rod, rod head, cover and grommet. Preferably, the cover 42' is of rigid material and has an inside surface closely adjacent the upper vertically extending tubular grommet portion 30' and, also, includes an axially extending portion above the grommet. This is so that when the cover is tilted by side-ways finger pressure, relatively little pressure is required, the axially extending portion of the tubular grommet portion acting as a lever. Thus, the grommet may be yieldingly tilted together with the rigid valve stem 22' from a normal vertical position. This causes a corresponding tilt of the valve stem base 36' and rod 32' out of sealing engagement of the apex 51' of the grommet lip 50' and the upwardly facing surface including the conical portion surface 47' of the valve stem rod for temporarily dispensing pressurized flowable material from the container. It will be seen that the elasticity of the grommet automatically returns the stem to a sealing position with the lip again being in sealing engagement with the conical portion upon removal of the tilting pressure.

Figure 2:
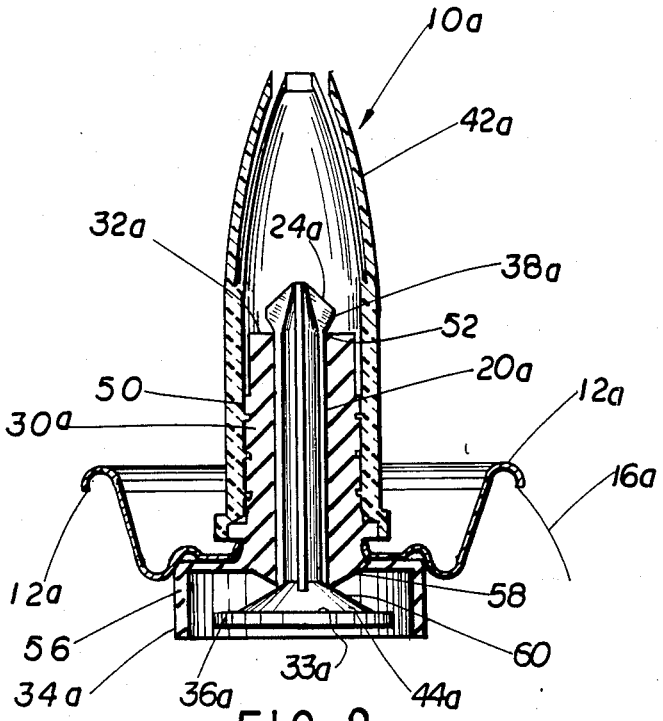
FIG. 2 is a schematic side elevation, party broken away, illustrating a first preferred embodiment of the improved valve of the present invention.

Referring now to FIG. 2, a valve **10*a* is shown. The components of this figure are generally similar to those of FIGS. 1 and FIG. 8 and hence bear the same numerals, but are succeeded by the letter "a". Valve 10*a* is generally similar to valve 10 including connector 12*a*, rod 20*a* of valve stem 22*a*, head 24*a*, grommet 32*a* and cover 42*a***, but as explained hereinafter, the structure differs in certain respects.

With continued reference to FIG. 2, cover **42*a* contains no ring detent such as 38 or walls 40, but is smooth-surfaced throughout the interior thereof for easy cleaning. Moreover, cover 42*a* does not contact head 24*a* at all. It is releasably secured to tubular part 30*a* of grommet 32*a* by sliding contact with frictionally gripping ribs 50 (FIG. 2) on the exterior surface of tubular portion 30*a* of grommet 32*a*, so that cover 42*a* can be pulled up from off of grommet 32*a* to easily and rapidly clean cover 42*a*, head 24*a*, grommet part 30*a* and rod 20*a*** in order to avoid health hazards and assure proper valve operation.

Moreover, the upper end 52 of grommet **32*a* abuts the underside of flanges 38*a* (FIG. 2) to hold valve stem 22*a* in the closed position (FIG. 2**).

The inside of the lower part 56 of grommet **32*a* defining that portion of the grommet wall 33*a* which bounds the passageway is specially configured (FIG. 3) to provide an improved annular ring seal 58 to prevent entrapment of solids from material to be disposed from can 16*a* and to avoid consequent leakage and oozing of dispensing material from can 16*a*, a health hazard and a waste of dispensing material. In this regard, seal 58 has a pointed inner rim 60 and is generally triangular shaped in transverse cross-section. Solids do not accumulate at rim 60 due to its pointed configuration. Moreover, its shape provides an improved contact seal, as opposed to the rounded shoulder of seal 47 of FIG. 1. Preferably, a bisectrix of the apex 60 or pointed rim of ring seal 58 s about perpendicular to the surface of portion 44*a*, and, under pressure, partially deforms at the conical portion 44*a***.

It will be noted that base **36*a* of valve stem 22*a* seats within the recess in the bottom opening skirt 34*a* of grommet 32*a* in the preferred embodiment for better alignment and protection of stem 22*a***; however, the skirt can be eliminated if desired.

Stem **22*a* can be of metal, plastic, ceramic, etc., while grommet 32*a* is preferably synthetic or natural rubber or plastic. Cover 42*a* can be relatively rigid material such as plastic or the like and connector 12*a*** is preferably metal (stainless, tin-plated or aluminum).

Valve **10*a* can be of any desired size. Typically, stem 22*a* can be about 0.86" long, with a 0.25 inch wide head 24*a* and 0.4 inch wide base 36*a*. Grommet 32*a* typically can be about 0.72 inch long, about 0.375 inch wide in portion 30*a* and up to 0.6 inch or more wide in base 34*a*. Connector 12 can be, for example, about 1.2 inches in diameter and 0.25 inch deep. Cover 42*a*** can be about 1.25 inches long and about 0.5 inch in average diameter.

Figure 3:
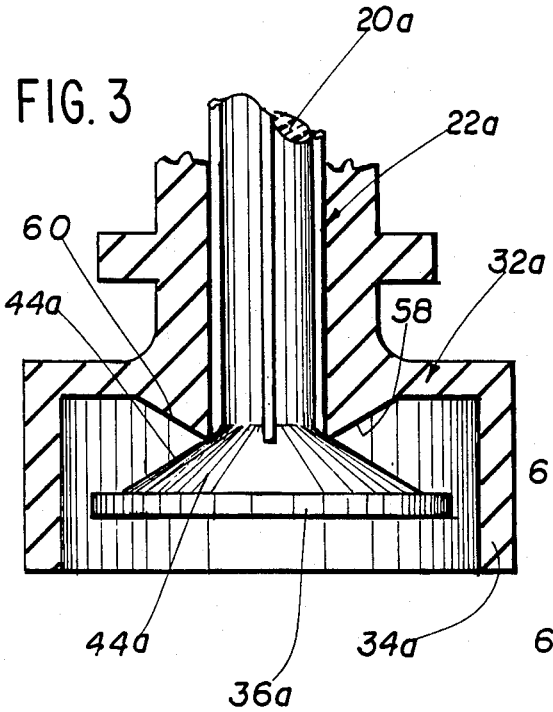
FIG. 3 is an enlarged, fragmentary schematic side elevation, partly broken away, and partly in section, illustrating the seal utilized in the valve of the present invention, showing in particular the reverse angle of the annular ring seal which is unique to this type of valve.

FIG. 3 is intended to illustrate the normal assembled valve insofar as the apex 60 of the ring seal 58 is concerned wherein it is shown in close adjacent relationship to the conical surface **44*a* when the base 36*a* is within the lower portion 34*a* of the grommet 32*a* with the rod 20***a* of the valve stem 22*a* extending upwardly through the passageway of the grommet.

Figure 4:
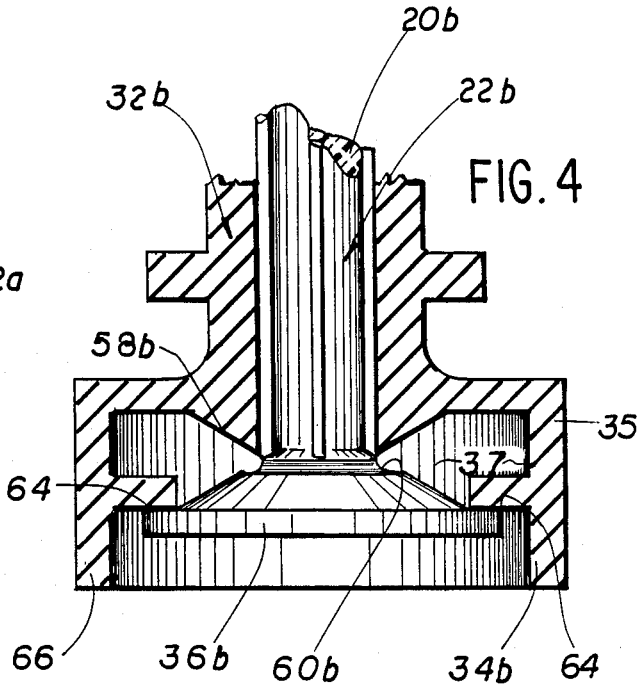
FIG. 4 is an enlarged fragmentary schematic side elevation, partly broken away, and partly in section of a second preferred embodiment of an improved grommet utilizable in the valve of FIG. 2, showing the grommet bearing an improved ring seal and a novel annular tilt ridge, the latter facilitating pivoting of the valve stem of the valve of FIG. 2, said stem being shown in the untilted position.
Figure 5:
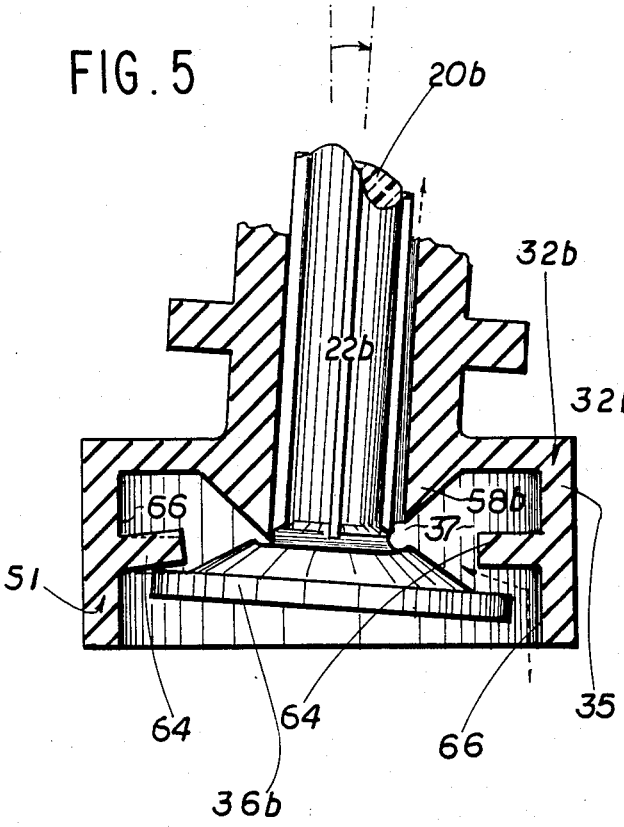
FIG. 5 is an enlarged fragmentary schematic side elevation, partly broken away, and partly in section, of the grommet and valve stem of FIG. 4 shown with the valve stem in the partially tilted early dispensing position.
Figure 6:
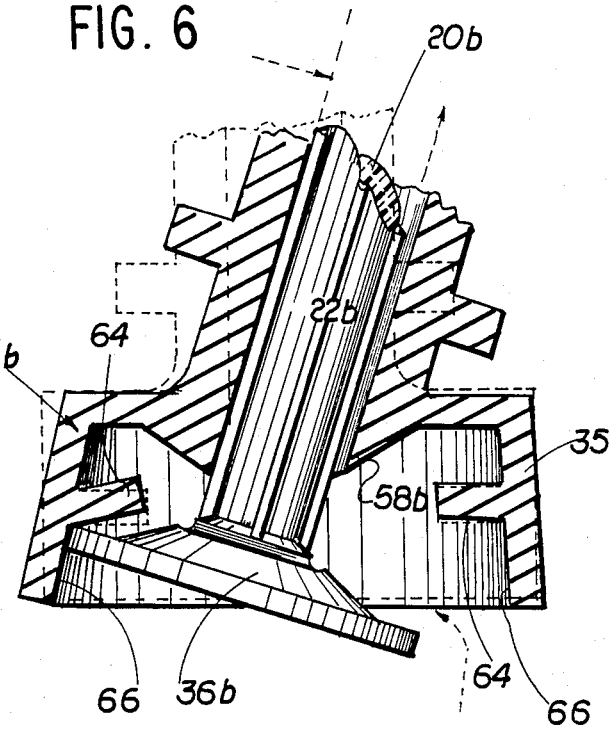
FIG. 6 is an enlarged fragmentary schematic side elevation, partially broken away and partially in section, of the grommet and valve assembly of FIG. 4 shown with the valve stem in a fully open position.

Referring now to FIGS. 4, 5 and 6, a modified version in the place of the grommet 32*a* utilizable in valve 10*a* is shown and designated 32*b;* it is schematically illustrated in FIGS. 4, 5 and 6. Thus, grommet 32*b* is shown. Components shown in FIGS. 4 and 5 similar to those of FIGS. 2 and 3 bear the same numerals but are succeeded by the letter "b". Grommet 32*b* is substantially identical to grommet 32*a* in all respects except that it includes a novel annular tilt ridge 64 projecting into the recess 37 of the skirt 35. Ridge 64 is preferably integral with grommet 32*b* and protrudes from the inner skirt wall surface 66 thereof below and peripheral of ring seal 58*b* but just above and in the tilt path of valve stem base 36*b* of rod 20*b* of valve stem 22*b*. Ridge 64 may be of any desired shape such as square or rectangular in transverse cross-section, or circular, oval, irregularly-shaped, etc. In a preferred embodiment, see FIG. 9, the grommet 32*b'* may have a ridge 64' integral with the grommet and extending as an annular thickened wall portion.

When valve stem 22*b* is tilted from its at rest position as shown in FIG. 4 to the position shown in FIG. 5, it tilts and causes partial displacement of base 36*b* away from seal 58*b* for passage of pressurized fluid. Further tilting of valve stem 22*b* to the position shown in FIG. 6 causes base 36*b* to tilt further as shown on ridge 64 to more rapidly move base 36*b* completely away from seal at 58*b* to allow a more rapid egress of pressurized fluid.

Ridge 64 acts as a fulcrum about which base 36*b* rapidly pivots for an earlier than otherwise lateral displacement of stem 22*b* and base 34*b* of grommet 30*b* from connector 12*b* and opening 18*b* and thus earlier than otherwise dispensing of liquid from the pressurized can (16*a* in FIG. 2). Not only is the dispensing earlier, but it also requires less pressure and is easier and smoother.

Grommet 32*b* can be fully substituted for grommet 32*a* in valve 10*a* with optimal results. Grommets 32*a* and 32*b* and the other components of improved valve 10*a* are inexpensive, durable, efficient and effective for improved rapid dispensing from can 16*a* without "blow-by," plugging or build-up of dispensed liquid or solids in and around the valve components.

A modified version of the grommet shown in FIGS. 4 through 6 is schematically illustrated in FIG. 7, thus grommet 32*c* is shown. Components shown in FIG. 7 similar to those of FIGS. 2 through 6, bear the same numerals, but are succeeded by the letter "c". Grommet 32*c* is substantially the same as grommet 32*b* in all respects except that the tilt ridge 64*c* is of a different design. Rather than presenting a separate annular ring projection as does tilt ridge 64, ridge 64*c* merely is an integral part of grommet 32*c*, with its lower portion lying in substantially the same horizontal plane as the lowermost pointed portion of ring seal 58*c*. This particular design is cleaner in construction, while still presenting a second pivot point at 51, to enable accelerated opening of a passageway for pressurized fluid at 49*c*, in the manner taught above with respect to stem 22*b*.

Various other modifications, changes, alterations and additions can be made in the improved valve of the present invention, its components and parameters. All such modifications, changes, alterations and additions as are within the scope of the appended claims form part of the present invention.

What is claimed is:

1. An improved valve for attachment to the open upper end of a container for controlling discharge of pressurized, flowable material from the container, said valve including sealing means effective for preventing "blow-by" and oozing through a range of pressures, from an initial, elevated pressure to a lower pressure when the flowable material is substantially discharged from the container, said valve comprising, in combination:

(a) a generally horizontally extending can connector of rigid material adapted to sealingly close the container about the open upper end, said connector having a vertical opening extending therethrough bounded by an edge, (b) a valve stem of rigid material comprising a generally horizontal base positioned below said connector and said opening, and said stem including a generally vertical rod extending upwardly from said base and through said opening, said rod including an upper distal end comprising a peripherally extending expanded open work head defining a surface facing said valve stem base, and said base having a generally conical portion having a surface extending upwardly and converging from said base to said rod, and said base having an upper axially facing surface including said conical portion surface, (c) a flexible, resilient, tubular grommet having an axial through passageway, said grommet including a lower portion defining an inverted dome-shaped axially downwardly facing surface having a lip about the passageway, and said grommet further including an upper axially extending portion surrounding said valve stem, said grommet extending up through said connector opening and being disposed around said valve stem rod with said rod in said passageway, and with said valve stem base closely adjacent said inverted dome-shaped surface, said grommet having an upper face about said passageway and said surface of said valve stem head facing said valve stem base being sized to normally dwell on said upper grommet face, said lower portion of said grommet being below said connector opening with said inverted dome-shaped axially downwardly facing surface confronting the upper surface of said valve stem base, said grommet and valve stem being sized and configured with the lip in a normal position in close adjacent relation to said conical surface, (d) mutually interengaging means on the grommet and on said connector to sealingly close about the edge of said vertical opening, (e) said grommet lip comprising a sealing ring in said passageway in sealing engagement with said generally conical surface of said rod when said valve is installed in closing relation of the open upper end of a pressurized container and axially upwardly directed forces are exerted on said valve stem base, said grommet lip comprising an annular, deformable, pointed grommet portion of generally triangular transverse cross-section as seen in elevation with the apex of said grommet portion defining a generally radially, inwardly and downwardly pointed, distally weakened, lip portion for sealing engagement with said conical portion of said rod, said inverted dome-shaped axially downwardly facing surface and lip apex being effective to deformingly and sealingly contact said upper axially facing surface including said conical portion surface when the container is under elevated, initial pressure to prevent "blow-by" of pressurized liquid and to eliminate entrapment of entrained solids between said grommet and valve stem, and as the pressure is reduced on removal of the flowable material from the container, said inverted dome-shaped axially downwardly facing surface and said pointed distally weakened portion are adapted to gradually relax returning toward its normal position with the apex of said lip portion maintaining sealing contact with the conical portion, (f) an open-topped tubular vertically extending cover releasably secured to the tubular portion of said grommet above said connector opening for removal of said cover and cleaning of said rod, rod head, cover and grommet, said cover being of rigid material and having an inside surface closely adjacent the upper vertically extending tubular grommet portion and having a portion extending above the grommet, so that when the cover is tilted sideways by finger pressure, said grommet will yieldingly tilt together with said rigid valve stem from said vertical position causing a corresponding tilt of said stem base and rod out of sealing engagement of the apex of said grommet lip and said upwardly facing surface including said conical portion surface of said rod for temporarily dispensing pressurized flowable material from said container, the elasticity of said grommet automatically returning said stem to a sealing position with said lip again being in sealing engagement of said conical portion upon removal of said tilting pressure.

2. The valve as set forth in claim 1 wherein said lower portion defines a cylindrical skirt about a downwardly opening skirt recess and said inverted dome-shaped axially downwardly facing surface comprises a roof surface within said skirt and, in assembly, said valve stem base is housed in said skirt recess closely adjacent said skirt roof surface.

3. The improved valve as set forth in claim 1 wherein the bisectrix of said apex is generally perpendicular to the surface of said generally conical rod portion surface.

4. The valve as set forth in claim 1 wherein said grommet is of elastomeric plastic rubbery material.

5. The improved valve of claim 2 wherein a generally annular ridge is disposed in said skirt recess between said apex and said rod base, in the tilt path of said space, said ridge acting as a fulcrum during tilting of said stem for more rapid displacement of said stem base to effect earlier dispensing than otherwise from said container.

6. The valve as set forth in claim 5 wherein said ridge is disposed next to and axially above said stem base.

* * * * *